United States Patent [19]

Braun

[11] Patent Number: 4,782,796

[45] Date of Patent: Nov. 8, 1988

[54] UNSYMMETRICAL FREE PISTON ENGINE

[76] Inventor: Anton Braun, 6421 Warren Ave. South, Minneapolis, Minn. 55435

[21] Appl. No.: 886,341

[22] Filed: Jul. 17, 1986

[51] Int. Cl.[4] ..... F22B 9/00

[52] U.S. Cl. ..... 123/46 SC

[58] Field of Search ..... 123/46 R, 46 A, 46 SC

[56] References Cited

U.S. PATENT DOCUMENTS

| | | | |
|---|---|---|---|
| 2,408,030 | 9/1946 | Beale | 123/46 R |
| 2,526,384 | 10/1950 | Mercier | 123/46 R |
| 3,501,088 | 3/1970 | Braun | 123/46 R |
| 3,610,214 | 10/1971 | Braun | 123/46 A |
| 3,610,216 | 10/1971 | Braun | 123/46 R |
| 3,853,100 | 12/1974 | Braun | 123/46 R |
| 3,944,299 | 3/1976 | Braun | 74/44 |

*Primary Examiner*—Charles J. Myhre
*Assistant Examiner*—David A. Okonsky
*Attorney, Agent, or Firm*—Alan M. Staubly

[57] ABSTRACT

An unsymmetrical and balanced free piston engine of economical construction in which the engine cylinder requires no liner. A housing surrounding the cylinder is opened for cylinder machining and is adapted for space-saving vertical mounting. It has an open-sided base portion through which an engine piston may be installed and removed for servicing, which lowers the initial cost of manufacturing and the later cost of maintenance, as compared with earlier engines of the same engine type.

9 Claims, 1 Drawing Sheet

UNSYMMETRICAL FREE PISTON ENGINE

This invention relates to an improved free piston engine of the unsymmetrical type which is easy to manufacture and maintain in good working condition. By constructing the engine housing so that its' longitudinal or piston axis, in engine operating position, extends vertically, it prevents uneven cylinder wall wear and also takes up desirably less floor space. Also, by providing one or more side openings in a base portion of the housing and openings at each end thereof, the engine's cylinder may be machined from either end and the engine's piston may be inserted initially and removed easily for servicing without having to dismantle the entire engine to get at the piston.

BACKGROUND

Free piston engines have been known for many years. They have been of relatively large and expensive construction and difficult to repair due to their construction. For these reasons, the trend has been to mount the engines with their longitudinal axes extending horizontally.

DRAWINGS

The preferred embodiments of the invention are illustrated in the accompanying drawings wherein.

DESCRIPTION

Figure 1:
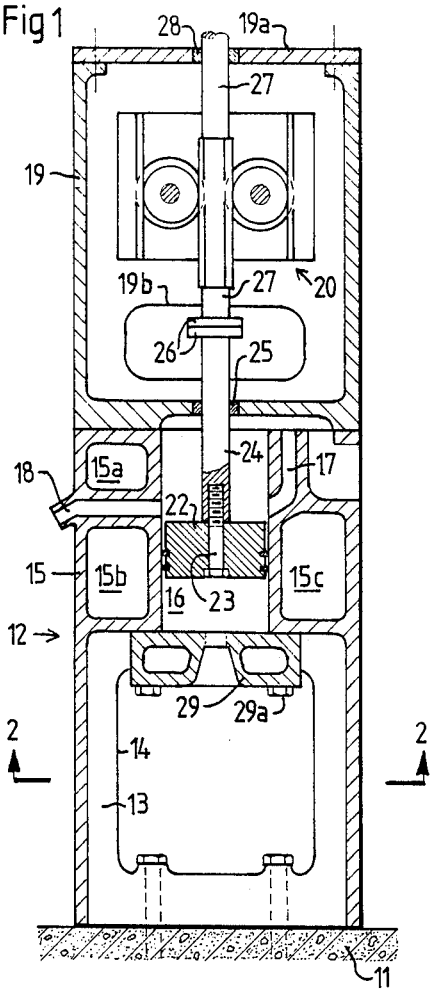
FIG. 1 is a generally schematic and vertical sectional view of the invention.

The preferred embodiment of the invention is illustrated as being bolted to a fixed base 11 although it may be secured to a movable carriage. It includes a housing, generally designated by the numeral 12, which includes a base portion 13 with at least one large side opening 14. It also has an engine cylinder housing portion 15 with a combustion cylinder 16 extending from the upper end of the base portion to the upper end of the cylinder housing portion. Between the cylinder wall and the outer wall of portion 15 are the usual water cooling passageways **15*a*, 15*b* and 15*c* and air inlet port 17 and exhaust port 18**.

Suitably mounted on top of portion 15 is a balancing housing portion or unit 19 containing a balancing mechanism generally designated by the numeral 20. The upper end of the unit 19 is closed with a plate **19*a* bolted thereon. The lower end of the cylinder is closed by a cylinder head 29 secured to the housing with bolts 29*a***.

Figure 4:
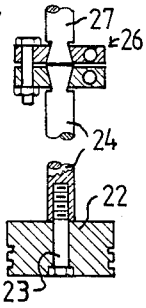
FIG. 4 is an enlarged fragmentary view of the engine piston, piston rod, drive shaft and coupling between the rod and shaft.
Figure 5:
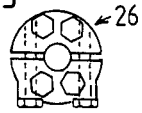
FIG. 5 is a plan view of a coupling between the piston rod andthe drive shaft that extends from the upper end of the engine.
Figure 2:
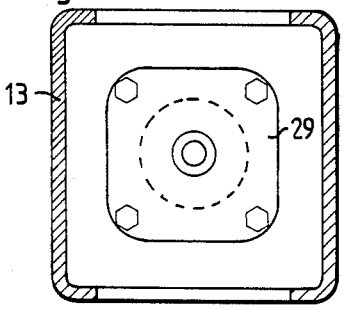
FIG. 2 is a horizontal sectional view taken along line 2—2 of FIG. 1.

Positioned in cylinder 16 is a piston 22 secured by a bolt 23 to a piston rod 24. The rod 24 extends through a suitable packing 25 located in the lower end of unit 19. The rod is operably connected by any suitable connector 26, such as the one illustrated in detail in FIG. 4 and FIG. 5, to a drive shaft 27 forming a part of the balancing mechanism. The drive shaft extends through a packing 28 in plate 21 for connection to any energy absorbing device, such as a compressor. At least one window or opening **19*b* in the side wall of unit 19 provides access to the connector 26 for connecting and disconnecting rod 24 to shaft 27**.

Figure 6:
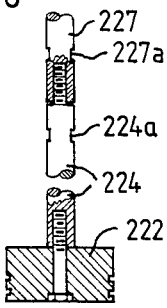
FIG. 6 is a fragmentary view of another type of connection between the rod and shaft.

FIG. 6 shows a screw threaded modification of the connection between the shaft and rod. It has flattened portions **224*a* and 227*a* on rod 224 and shaft 227** for engagement by wrenches to rotate the rod with respect to the shaft.

OPERATION

The operation of the engine is conventional except that due to its vertical mounting, the wear on the cylinder wall and in the bearings is reduced and the remaining radial thrust of the piston and piston rod is evenly distributed all around the cylinder and bearing walls. This eliminates the need for a separate cylinder liner made of harder material than that of the housing and extends the life of the engine.

Assuming the machine has been installed for end use and the piston rings have become worn, bolts **29*a* and head 29 may be removed through opening 14, rod 24 may be disconnected from shaft 27 by unbolting the connector 26 through opening 19*b*** and then the piston may be lowered into the space in the base portion for servicing. Clearly the initial and the reassembly of these parts may take place by reversing the above procedure.

Figure 3:
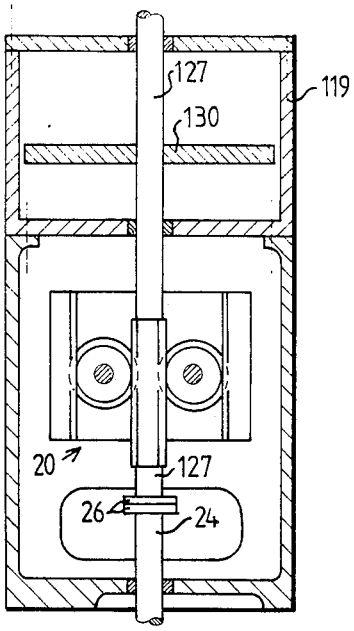
FIG. 3 is a fragmentary vertical sectional view taken of a modification of the invention embodying a bounce piston therein.

The modification of FIG. 3 is the same as that of FIG. 1 except that it shows how a bounce piston 130 and housing 119 may be added to the housing 19. This shows that what is mounted above the machine is quite selectable, without increasing the work involved in servicing the power portion of the engine.

The modification of FIG. 6 shows a threaded connection between the piston 222 and piston rod 224 which enables the piston to be lowered into the space in the housing by either removing the bolt between it and the piston rod or by rotating the piston and rod with respect to the drive shaft. In either procedure it is accomplished by operating through the opening 14.

I claim:

1. An unsymmetrical free piston engine comprising a housing having a base portion with open upper and lower end portions and at least one side opening, an engine cylinder portion positioned above said base portion and extending from said upper end of said base portion to an upper end of said cylinder portion and providing an open-ended combustion chamber, a cylinder head detachably secured to said cylinder portion across a lower end thereof, a balancing unit mounted above the upper end of said cylinder portion and having a window in a side wall thereof, a piston in said cylinder portion and having a piston rod extending from said piston through sealing means in a bottom of said balancing unit, balancing means in said unit including a drive shaft that extends through sealing means in an upper end of said balancing unit for connection with an energy absorbing device, and said drive shaft being operably connected to said piston rod.

2. An unsymmetrical free piston engine as defined in claim 1 wherein said connection between said shaft and said rod is readibly separated from said shaft and rod to enable said piston to be lowered into said base portion for servicing.

3. An unsymmetrical free piston engine as defined in claim 1 wherein said connection between said shaft and rod may be broken by being manipulated through said window.

4. An unsymmetrical free piston engine as defined in claim 1 wherein the adjacent ends of said shaft and said rod have flattened portions for engagement by wrenches to disconnect said rod from said shaft by relative rotation therebetween.

5. An unsymmetrical free piston engine as defined in claim 1 wherein the longitudinal axis of the engine cylinder is supported vertically on said base portion.

6. An unsymmetrical free piston engine as defined in claim 1 wherein said base portion and said engine portions are integral.

7. An unsymmetrical free piston engine comprising a housing having a base portion with an open upper end portion and at least one side opening, an engine cylinder portion positioned above said base portion and extending from said upper end of said base portion to an upper end of said cylinder portion and providing an open-ended combustion chamber, a cylinder head detachably secured to a lower end of said cylinder portion, a balancing unit mounted above and closing an upper end of said cylinder portion, a piston in said cylinder portion and having a piston rod extending from said piston through sealing means in the bottom of said balancing unit, balancing means in said unit including a drive shaft that extends through sealing means in an upper end of said balancing unit for connection with an energy absorbing device, and said drive shaft being operably connected to said piston rod.

8. An unsymmetrical free piston engine as defined in claim 7 wherein said connection between said shaft and said rod is readibly separated from said shaft and rod to enable said piston to be lowered into said base portion for servicing.

9. An unsymmetrical free piston engine as defined in claim 7 wherein said connection between said shaft and rod may be separated by rotation of said piston or piston rod from within said window.

* * * * *